US005453770A

United States Patent [19]

Katakura et al.

[11] Patent Number: 5,453,770

[45] Date of Patent: Sep. 26, 1995

[54] ON-DEMAND TYPE INK JET PRINT HEAD

[75] Inventors: Takahiro Katakura; Toshio Kumagai; Shinji Yasukawa; Hideaki Sonehara; Masanao Matsuzawa; Fujio Akahane; Norihiko Kurashima; Toshiaki Ohshima; Katsuhiko Iida, all of Nagano, Japan

[73] Assignee: Seiko Epson Corporation, Tokyo, Japan

[21] Appl. No.: 897,017

[22] Filed: Jun. 11, 1992

[30] Foreign Application Priority Data

Jun. 13, 1991 [JP] Japan ..... 3-168880

[51] Int. Cl.[6] ..... B41J 2/175; B41J 2/045

[52] U.S. Cl. ..... 347/85; 347/72

[58] Field of Search ..... 346/140 R; 347/71, 347/72, 92, 85; B41J 2/045, 2/175, 2/19, 2/18

[56] References Cited

U.S. PATENT DOCUMENTS

| | | | |
|---|---|---|---|
| 3,953,862 | 4/1976 | Amberntsson et al. | 346/140 R |
| 4,785,315 | 11/1988 | McCormick et al. | 346/140 R |
| 5,177,504 | 1/1993 | Ishii et al. | 346/140 R |

FOREIGN PATENT DOCUMENTS

| | | | |
|---|---|---|---|
| 0083877 | 7/1983 | European Pat. Off. | B41J/2/045 |
| 0252677 | 1/1988 | European Pat. Off. | B41J/2/19 |
| 443628 | 8/1991 | European Pat. Off. | B41J/2/045 |
| 57-109665 | 7/1982 | Japan | B41J/2/175 |
| 59-31165 | 2/1984 | Japan | B41J/2/19 |
| 2-45985 | 10/1990 | Japan | B41J/2/045 |
| 2-52625 | 11/1990 | Japan | B41J/2/045 |
| 3-197049 | 8/1991 | Japan | 347/72 |
| 4001052 | 1/1992 | Japan | B41J/2/045 |
| 90-10845 | 9/1990 | WIPO | B41J/2/175 |

OTHER PUBLICATIONS

Proceedings—The Fifth International Congress on Advances in Non–Impact Printing Technologies Nov. 12, 1989; San Diego, Calif.; pp. 567–576, Hine Nathan, P.

*Primary Examiner*—Benjamin R. Fuller
*Assistant Examiner*—Alrick Bobb
*Attorney, Agent, or Firm*—Sughrue, Mion, Zinn, Macpeak & Seas; Richard C. Turner; Raymond H. J. Powell, Jr.

[57] ABSTRACT

An on-demand type ink jet print head, comprising: a plurality of ink tanks disposed at a lower position of a carriage to be independent of each other, pressure varying means provided on one of the tanks; an air release port communicating with the other one of the tanks; a head assembly provided on top of the tanks to communicate with the tanks through flow paths at both sides of the head assembly. The object of the invention is to achieve stable printing independent of the amount of ink in an ink tank and discharge bubbles in a nozzle head together with the ink.

17 Claims, 11 Drawing Sheets

ON-DEMAND TYPE INK JET PRINT HEAD

BACKGROUND OF THE INVENTION

(Field of the Invention)

The present invention relates to an on-demand type ink jet print head that prints data by jetting ink in a pressure chamber onto a recording medium from nozzle openings in the form of ink droplets upon input of a print signal and thereby forming dots on the recording medium by such ink droplets.

(Prior Art)

A so-called "on-demand type ink jet print head" that forms ink droplets by input of a print signal roughly comes in three types. The first is a bubble jet type in which a heater is arranged on the front end of a nozzle to instantaneously gasify ink, whereby ink droplets are produced and jetted by expansive pressure at the time the ink is gasified. The second is a type in which a part of a container forming ink reservoir is formed of a piezoelectric element that deforms by a print signal, whereby ink is jetted in the form of droplets by pressure produced within the container by deformation of the piezoelectric element. The third is a type in which a piezoelectric element is arranged in a pressure chamber having a nozzle opening, whereby ink is jetted in the form of droplets from the nozzle by varying the ink pressure in the pressure chamber by expansion and contraction of the piezoelectric element.

As disclosed in Japanese Patent Examined Publication Nos. 45985/1990 and 52625/1990, the above three types of on-demand type ink jet print heads are so designed that one end of a piezoelectric element whose other end is fixed to a base is brought into resilient contact with a vibrating film forming a pressure chamber, so that ink in the pressure chamber can jet in the form of droplets from a nozzle opening while causing the vibrating film to be deformed by expansion and contraction of the piezoelectric element.

Since these print heads receive ink from an ink tank through a pipe, ink supply piping is necessary, and this makes a head assembly large in structure. In addition, ink supply pressure must be maintained constant, and in the case of supplying the ink while utilizing a difference in water head, the ink pressure to be applied to the print head varies depending on the remaining amount of ink, thereby causing inconsistency in print quality. Further, removal of bubbles that have entered into the print head entails a waste of ink due to the bubbles being sucked together with the ink by applying negative pressure to the nozzle openings.

SUMMARY OF THE INVENTION

A first object of the invention is to provide an on-demand type ink jet print head featured as minimizing a difference in water head between nozzle openings as much as possible and requiring no sucking out of the ink to remove bubbles.

A second object of the invention is to provide an on-demand type ink jet print head featured as having minimal crosstalk.

A third object of the invention is to propose techniques for operating an on-demand type ink jet print head, such as a technique for replenishing ink to the tanks, a technique for removing bubbles having entered into the head assembly, and the like.

Other objects of the invention will become more apparent from the following description of preferred embodiments.

To achieve the above objects, the invention is characterized as forming a plurality of independent tanks at a part that is on a lower side when mounted on a carriage. One of the tanks has a pressure varying means and the other tank communicates with an air release port. A head assembly is arranged on top of the tanks so as to communicate with the respective tanks by means of flow paths disposed on both sides of the head assembly.

If the pressure of one of the tanks is varied by a pump with a nozzle opening surface of the head assembly sealed by a cap or the like, then ink in this tank moves to the other tank via the head assembly. It is during this process that bubbles having entered into the head assembly are discharged into the other tank. These bubbles are then released into the atmosphere from the air release port.

When the pressure in the two tanks is released to the atmosphere upon end of the discharging of the bubbles, the ink moves from one tank to the other via the head assembly so that the ink levels in the tanks come to be equal to each other. As a result, the ink that has passed through the head assembly at the time the bubbles have been discharged is replenished for printing again, thus producing no waste of ink. Further, since the head assembly is connected to the tanks by siphonage, the ink is supplied at a certain water head independently of the ink level in the tanks, thus allowing stable printing to be achieved.

DETAILED DESCRIPTION OF THE PREFERRED EMBODIMENTS

Embodiments of the invention will now be described with reference to the accompanying drawings.

Figure 2:
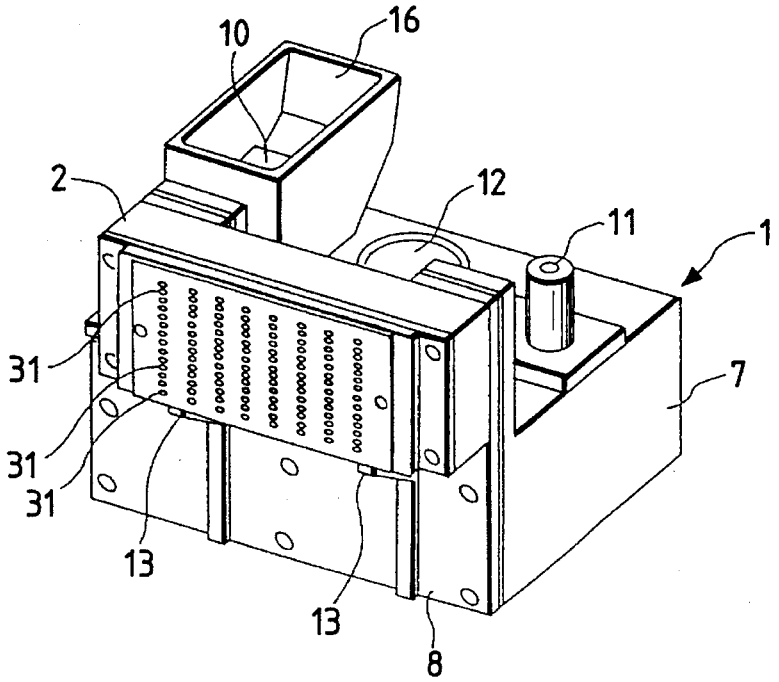
FIG. 2 is a perspective view showing an appearance of a print head of the invention.
Figure 3:
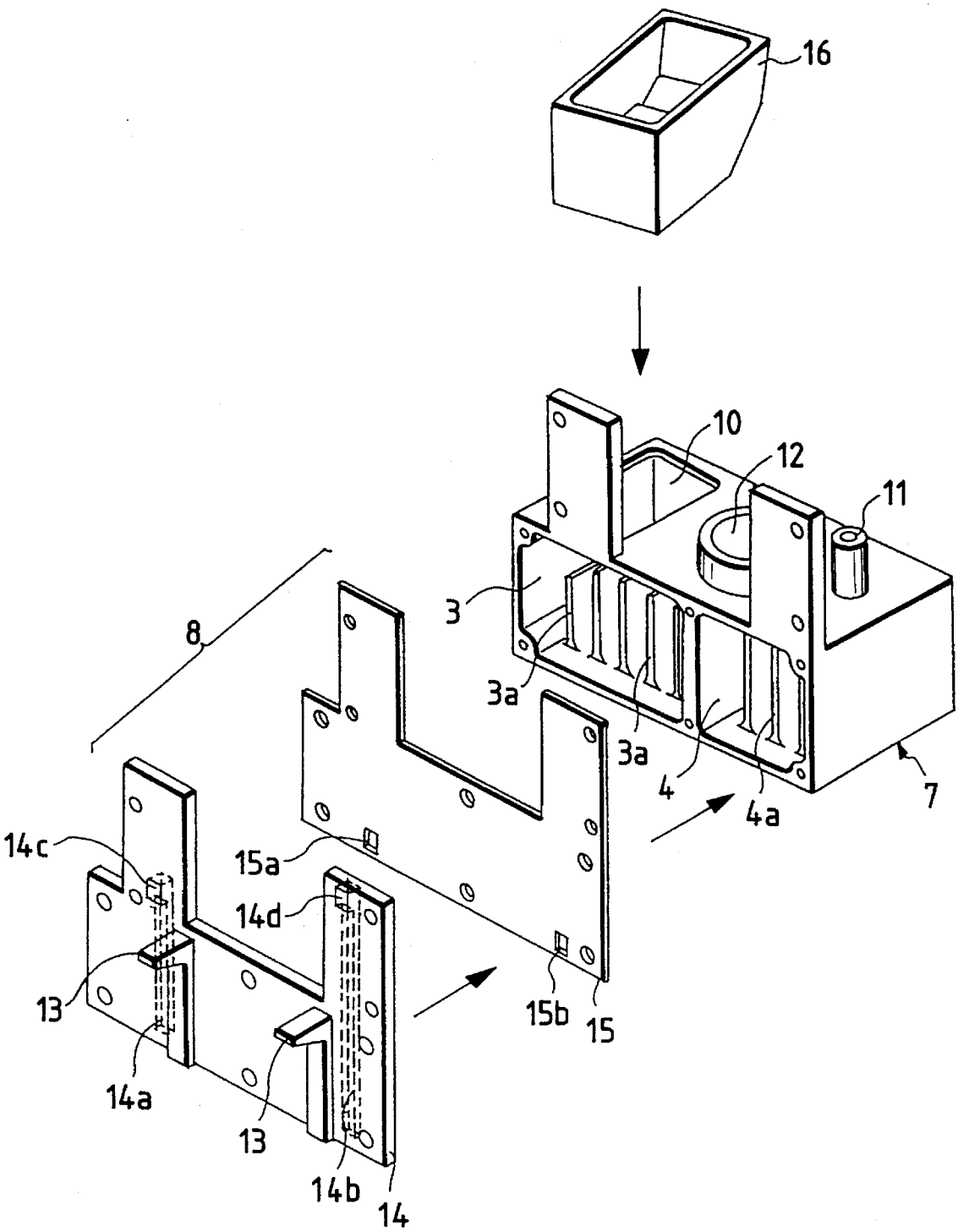
FIG. 3 is an exploded perspective view showing an embodiment of a base forming the print head.

FIG. 2 shows an appearance of a print head of the invention. In FIG. 2, reference numeral 1 designates a base serving also as a carriage mounting member. In this base a main tank 3 and a sub tank 4, which are independent of each other as shown in FIG. 3, are disposed at a position lower than a head 2 when mounted on the carriage. In the respective tanks are partitions 3*a*, and 4*a*.

Returning to FIG. 2, the base 1 includes a portion 7 that forms a tank body and a cover member 8 that seals a front end of the tank body portion 7. The tank body portion 7 has an ink replenishing port 10 on top of the main tank 3, an air release port 11 on top of the sub tank 4, and a heater mounting hole 12 between these tanks 3, 4 as the provision for using hot melt ink. The air release port 11 permits passage of gas, and at the same time, is sealed by a member that blocks passage of liquid, such as a filter 17 made of porous fluorine-containing resin or porous silicon.

Figure 9:
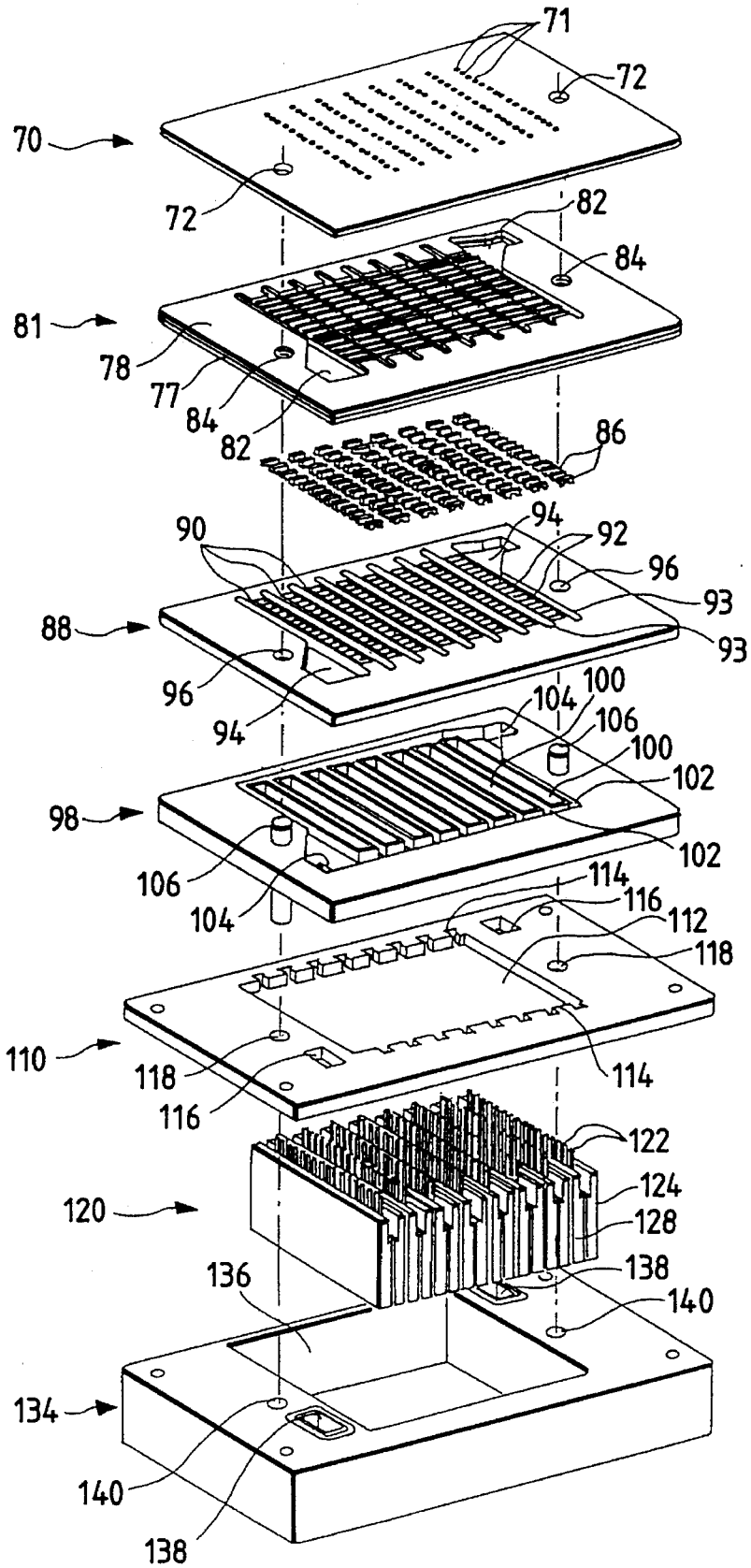
FIG. 9 is an exploded perspective view showing another exemplary head assembly of the invention.

The cover member 8 includes a front plate 14 and a back plate 15 as shown in FIG. 3. In front of the front plate 14 are arms 13, 13 that support the print head 2 and grooves 14*a*, 14*b*, each forming a flow path that allows the respective tanks 3, 4 to communicate with a head assembly 2 (described later) in cooperation with the back plate 15. On the upper ends of the respective grooves 14*a* and 14*b* are throughholes 14*c* and 14*d* that communicate with ink supply ports 138, 138 of the head assembly 2 (FIG. 9). On the back plate 15 are throughholes 15*a* and 15*b* that communicate with the lower ends of the respective grooves 14*a* and 14*b* formed on the front plate 14, so that the respective grooves 14*a* and 14*b* can communicate with the main tank 3 and the sub tank 4, respectively, at lower positions of the tanks. In FIG. 3, reference numeral 16 designates an ink receiving member to be used when ink is replenished.

Figure 1:
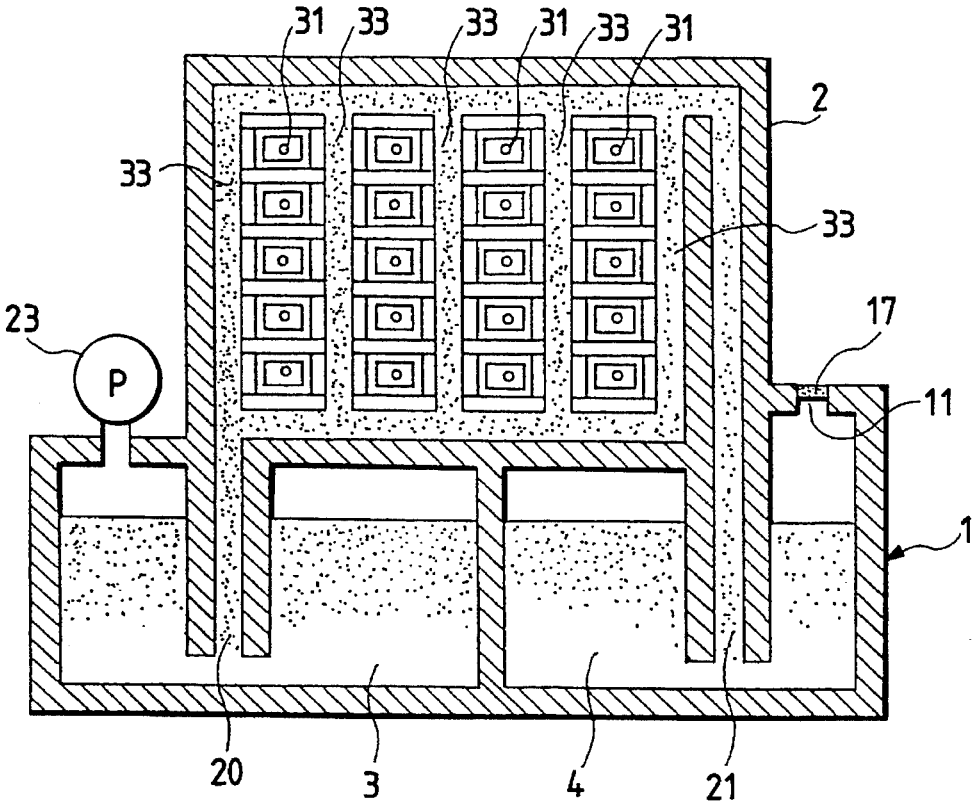
FIG. 1 is a diagram showing an embodiment of the invention with ink flow paths.

FIG. 1 roughly shows the print head of the invention by way of a flow path structure. The head assembly 2 communicates with the bottom portions of the respective tanks 3, 4 on the side thereof by means of vertically extending flow paths 20 and 21 that are formed of the grooves 14*a* and 14*b* of the cover member 8 so that the head assembly 2 can be connected to the main tank 3 and the sub tank 4 by siphonage. The head assembly 2 has, as will be described later, nozzle openings 31 so that the head assembly 2 can communicate with the air. The size of each nozzle opening 31 is as small as 60 μm in diameter so that the siphoning action is maintained by the meniscus.

In such a construction, when the main tank 3 is pressured or evacuated by supplying air from, e.g., a pump or by a sucking means 23 with the entire surface over the nozzle openings 31 hermetically sealed with a cap, a difference in pressure is produced between the main tank 3 and the sub tank 4. As a result, the ink in a tank whose pressure is higher, e.g., the main tank 3, flows into the sub tank 4 whose pressure is lower via the head assembly 2. At this point, the air in the sub tank 4 that is compressed by the flowing of the ink is released into the atmosphere from the filter 17, thereby maintaining the sub tank 4 at atmospheric pressure. Even if the pressure of the main tank 3 is increased so much as to cause the ink level to reach the filter 17, the filter 17, having the function of blocking fluid, the ink will in no way outflow.

In the ink moving process the bubbles in the head assembly 2, riding on the ink flow, are bound to be discharged into, e.g., the sub tank 4. When the main tank 3 is caused to communicate with the atmosphere upon movement of the ink by a predetermined amount, the ink moves via the head assembly 2 until the difference in water head between the main tank 3 and the sub tank 3 is eliminated, while the bubbles that have flown into the sub tank 4 are released into the atmosphere from the air release port 11.

Since the bubbles in the head assembly 2 have been removed by moving the ink from one tank 3 to the other tank 4 in this way, no such operation as sucking the ink from the nozzle openings is required as in a conventional head assembly in which bubbles are removed by applying a negative pressure to the nozzle openings. Thus, even in the case where large amounts of bubbles are produced at the time of melting, particularly, such as in hot melt ink that involves melting of solid ink for use, there is no waste of ink by sucking out, thereby contributing to a reduction in operating cost.

Further, the head assembly 2 is disposed at a position higher than the ink tanks 3 and 4 and is supplied with ink from the bottom of each of the tanks 3 and 4 by siphonage. As a result, the ink is supplied to all the nozzle openings 31 at a certain pressure irrespective of the levels of ink in the tanks 3, 4, thereby allowing stable ink droplets to be formed.

Figure 4A:
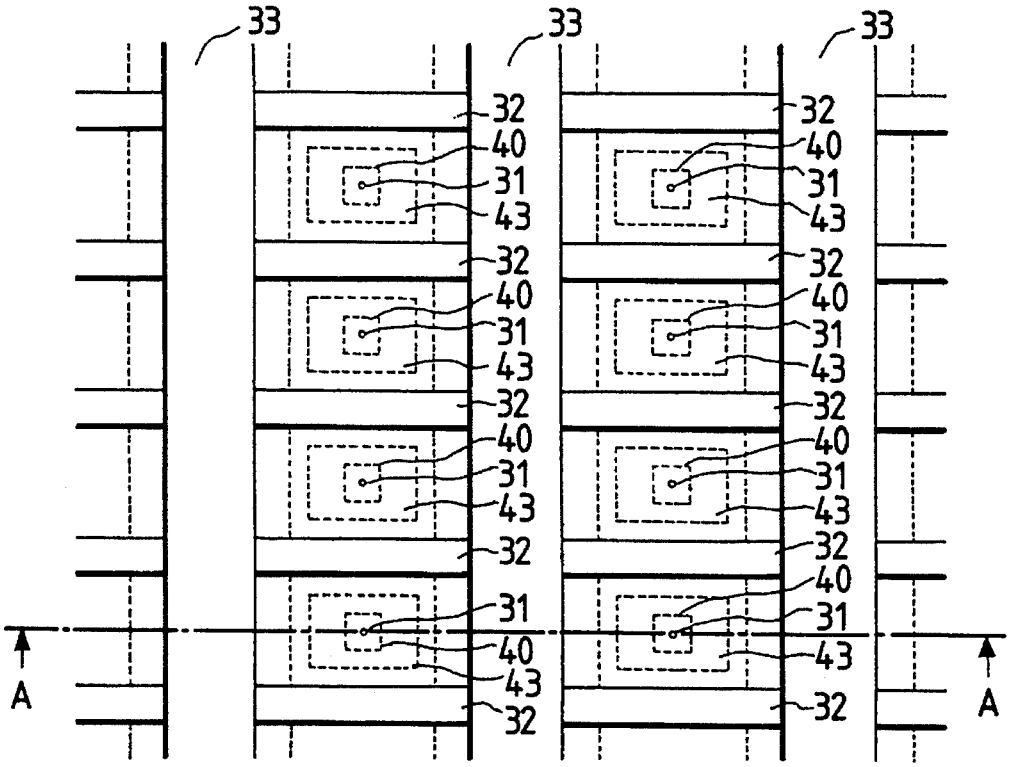
FIGS. 4 (*a*) and 4(*b*) are diagrams showing an embodiment of a head assembly, of which FIG. 4 (*a*) is a front view of the head assembly and FIG. 4 (*b*) is a diagram showing a cross-section taken along a line A—A shown in FIG. 4 (*a*)
Figure 4B:
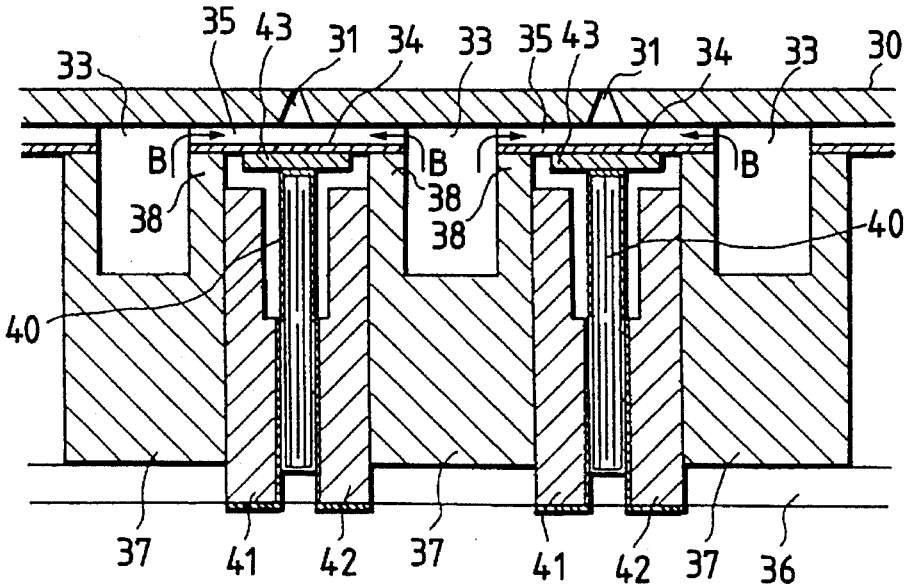
Figure 5:
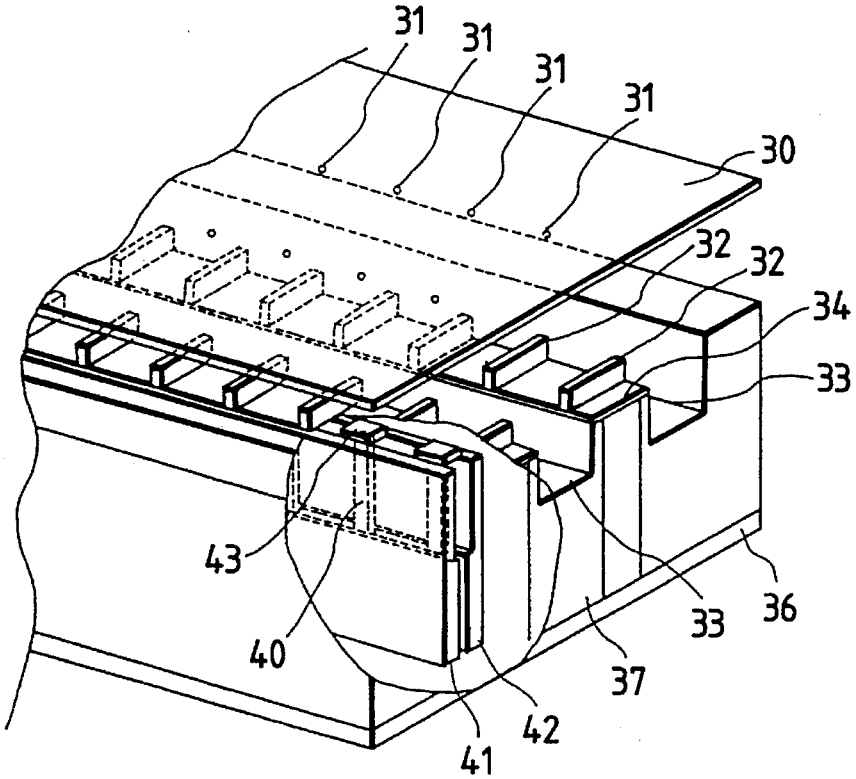
FIG. 5 is a perspective view showing an exemplary head assembly of the invention.

FIGS. 4 (*a*) and 4(*b*) and FIG. 5 show an embodiment of the head assembly. In FIGS. 4 (*a*) and 4(*b*) and FIG. 5, reference numeral 30 designates a nozzle plate, which has a plurality of nozzle openings 31 extending in a sheet forward direction in the form of an array (in a vertical direction as viewed in the figures). A plurality of such arrays of nozzle openings are arranged in an auxiliary scanning direction (in a horizontal direction as viewed in the figures). These nozzle openings 31 are isolated from one another in the vertical direction by walls 32 so that the ink can be supplied from ink flow paths 33 which interpose the nozzle openings therebetween.

Reference numeral 34 designates a vibrating plate, which is arranged at a predetermined distance from the nozzle plate 30 so as to form a pressure chamber 35 with respect to the nozzle plate 30. An end of the vibrating plate 34 is fixed on a front end of a support member 37 that is carried on a base 36. On a side of the support member 37 confronting the nozzle plate project wall surfaces 38 so as to form a groove 33 for supplying the ink to the pressure chambers 35. The vibrating plate 34 is firmly secured to a front end of the wall surface 38 so that the vibrating plate 34 can be supported. By the way, at the time the ink is jetted, i.e., when a vibrating element 40 is expanded and contracted, stress acts also on the wall surface 38 through the vibrating plate 34, thereby causing the support member 37 to be distorted. As a result, the gap between the nozzle plate 30 and the vibrating plate 34 having an array of nozzle openings to which the expanded and contracted vibrating plate belongs changes. The phenomenon of jetting the ink from nozzles by such change of gap, the so-called "crosstalk," is likely to occur. In order to prevent such trouble from happening, it is desirable to employ a means for increasing the strength of the support member 37 to a possible degree. For example, a material such as titanium that is lightweight and highly synthetic may be used, or a reinforcing plate may be mounted at a lower region of the support member. The inventors have found that a practically adequate print quality can be ensured by suppressing a distortional displacement of the support member 37 to such a degree as from 1/9 to 1/11 times a displacement of the vibrating plate 34 due to expansion and contraction of the vibrating element 40. As a result of the above structure, the ink can flow into the pressure chamber 35 in a stream shown by arrow B in FIG. 4(*b*) from the groove 33 whose fluid resistance is relatively small. Further, since the vibrating element 40 (described later) can be isolated from the ink, shortcircuiting of the vibrating element between the electrodes can be obviated even in the case of using electrically conductive ink.

Reference numeral 40 designates the above-mentioned vibrating element. The vibrating element 40 is divided into two regions in an axial direction. On both sides of an inactive region (lower as viewed in FIG. 4(*b*)), i.e., the side that exhibits no piezoelectric effect, substrates 41, 42 are bonded. This inactive region is fixed on the base 36 through these substrates 41 and 42. Each of the substrate 41 and 42 is made of a material whose acoustic impedance is larger than the vibrating element 40, e.g., alumina or metallic silicon. On the other hand, on the end of an active region of the vibrating element 40, i.e., the region expanding and contracting upon application of a signal, a pressure transmitting member 43 is fixed. This active region is connected to the vibrating plate 34 through the pressure transmitting member 43. By providing the inactive region and fixing such region in this way, repetitive expansion and contraction of the vibrating element 40 do not produce distortion on the bonded surfaces between the substrates 41 and 42 and the vibrating element 40. This contributes to minimizing the fatigue and thereby increasing the life of the vibrating element 40, the substrates 41 and 42, and the bonded surfaces. In addition, since the acoustic impedance of the substrates 41 and 42 is larger than that of the vibrating element 40, abnormal vibrations can be prevented by positively reflecting elastic undulations produced within the vibrating element 40 on the surfaces of the substrates 41 and 42, thereby ensuring that vibrating components effective in jetting the ink will be transmitted to the vibrating plate 34.

Further, since the vibrating element 40 is connected to the vibrating plate 34 through the pressure transmitting member 43, in the case of using a small vibrating element, if the pressure transmitting member is fabricated in a size larger than the end surface area of the vibrating element 40 and smaller than the area of the vibrating plate 34, the expansion and contraction of the vibrating plate 34 can be transmitted effectively to the vibrating plate 34. As a result, ink jetting performance can be improved.

Figure 6:
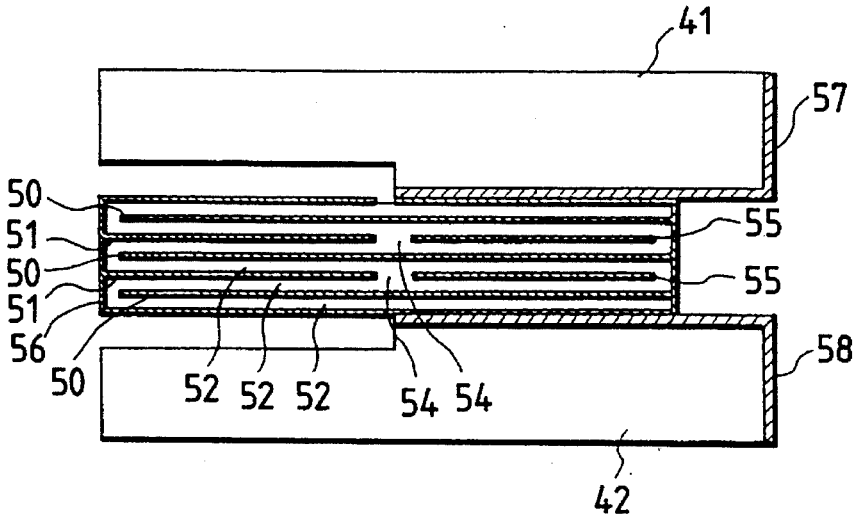
FIG. 6 is a sectional view showing an exemplary vibrating element unit.

FIG. 6 is a diagram showing an embodiment of the above-mentioned vibrating element. This vibrating element includes a first layer forming a first electrode 50, a second layer forming a piezoelectric layer 52, and a third layer forming a second electrode 51. The first electrode 50 is a thin coating made of a silver-palladium (Ag—Pd) or platinum (Pt) containing electrically conductive coating material prepared as a paste. The second layer is a thin coating made of a piezoelectric element material, e.g., a lead titanate or lead zirconate containing composite perovskite ceramic material prepared as a paste. The third layer is a thin coating made of the silver-palladium (Ag—Pd) or platinum (Pt) containing electrically conductive material prepared as a paste. These three layers are laminated on a surface plate so that each electrode layer is interposed between the piezoelectric layers. At this point, electrodes, which are the electrodes 51 in this embodiment, are cut off almost at middle portions 54 thereof to stop conductivity. An electrode forming material is coated on each of the first electrodes 50 so as to expose from an end surface (the right end surface as viewed in FIG. 6) and on each of the second electrodes 51 are formed so as to expose from the other end surface (the left end surface as viewed in FIG. 6). The vibrating element thus prepared in laminated form with a predetermined number of layers is dried, and then baked at temperatures from 1000° to 1200° C. for about one hour while applying pressure.

A vibrating element plate in the form of a single board has a structure such that each of the first electrodes 50 forming one of a pair of electrodes, exposes one end thereof to an end surface of the vibrating element, with the other end thereof being covered with the piezoelectric layer, while one end of each of the second electrodes 51 is exposed to the other end surface of the vibrating element with the other end thereof being covered with the piezoelectric layer.

The vibrating element is formed by cutting this vibrating element plate in strip-like form or slitting the plate in comb-like form while leaving one end thereof not slitted into a predetermined size using a dicer or a diamond cutter.

Electrically conductive layers 55 and 56 on both end surfaces of the vibrating element are formed, so that the electrodes 50 whose polarities are the same, can be connected in parallel with one another by the electrically conductive layer 55 and the electrodes 51 by the electrically conductive layer 56. If these electrically conductive layers 55 and 56 are fixed with an electrically conductive adhesive to electrically conductive layers 57 and 58 formed on the substrates 41 and 42, respectively, then the layers 55 and 56 can be connected to external sources electrically. The vibrating element can provide an adequate ink jetting output even with a minimal voltage because the piezoelectric layers 52 are very thin and because the respective electrodes 50 and 51, producing a drive electric field, are connected in parallel with each other.

Further, the electrodes 51 are electrically disconnected by the piezoelectric material at the middle portions thereof 54 and 54. Therefore, it is only a free end side (the left side as viewed in FIG. 6) that expands and contracts upon application of an exciting voltage, while leaving no voltage applied to the regions secured to the substrates 41 and 42. As a result, there will be in no way a case where undesired force acts on the vibrating element, thereby ensuring a long life. In addition, since the vibrating element has a general structure in which a layer made of a piezoelectric material and a layer made of an electrode material are as uniformas possible; in other words, since the whole structure of the vibrating element is such that the electrodes extend as far as to the inactive region, warpage or bending of the vibrating element due to temperature change or secular deterioration over time can be prevented.

Figure 7:
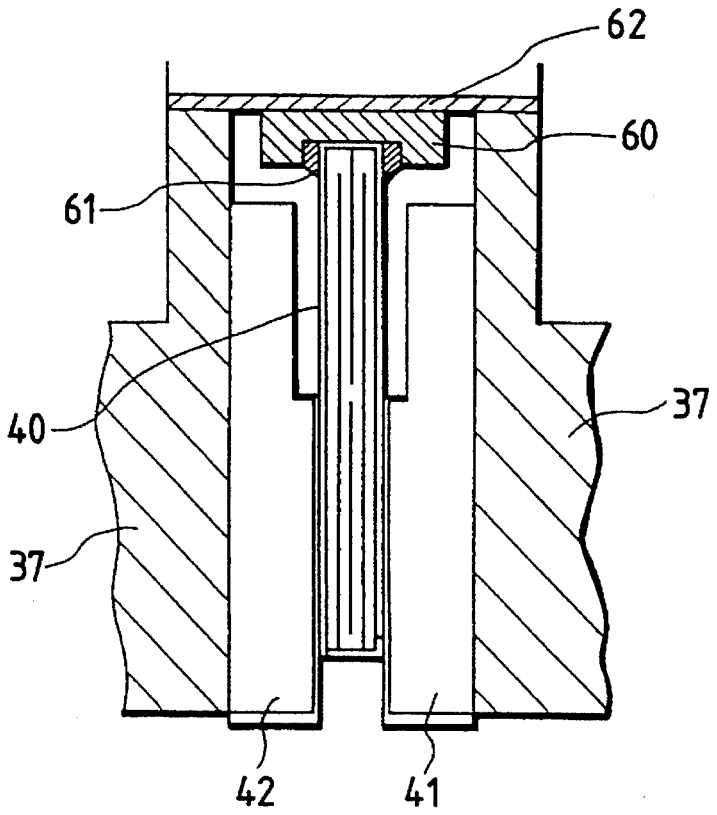
FIG. 7 is a sectional view showing a structure for connecting a vibrating element and a vibrating plate.

FIG. 7 shows a structure by which the vibrating plate is connected to the front end of the thus constructed vibrating element. The front end of the vibrating element 40, which is the free end side thereof, is covered with a cup-like pressure transmitting member 60. The pressure transmitting member 60 has on the back surface thereof a recessed portion whose size is slightly larger than the size of the front end of the vibrating element 40, and the recessed portion side of the pressure transmitting member 60 confronts the vibrating element 40. The pressure transmitting member 60 is secured by loading a heat-resistant adhesive 61 into the free space in the recessed portion to ensure that the pressure transmitting member 60 will be in contact with a vibrating plate 62.

Accordingly, the effect of not only preventing the outflow of the adhesive, but also positioning the pressure transmitting member at the very small front end surely can be provided.

Figure 8:
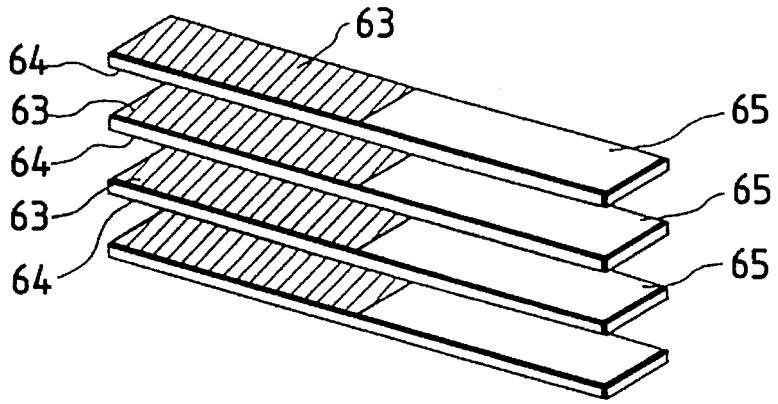
FIG. 8 is a diagram showing another exemplary vibrating element.

While the case of preparing a plurality of layers integrally has been described in the above-mentioned embodiment, it is apparent that the same effect can be obtained by fixing a plurality of piezoelectric vibrating plates 65, each vibrating plate having at one end thereof electrodes 63, 64 bonded integrally on both sides with an adhesive as shown in FIG. 8.

FIG. 9 shows a print head structure in the form of an exploded lamination structure. In FIG. 9, reference numeral 70 designates a nozzle plate. The nozzle plate has a plurality of nozzle openings 71 formed by electroforming when made of nickel as a material, by etching when made of metallic silicon, or by press working when made of stainless steel, nickel, or brass. These nozzle openings 71 are arranged so as to form a vertical array when mounted on a carriage. There are a plurality of such arrays. In FIG. 9, reference numeral 72 designates positioning holes for assembling.

Figure 10:
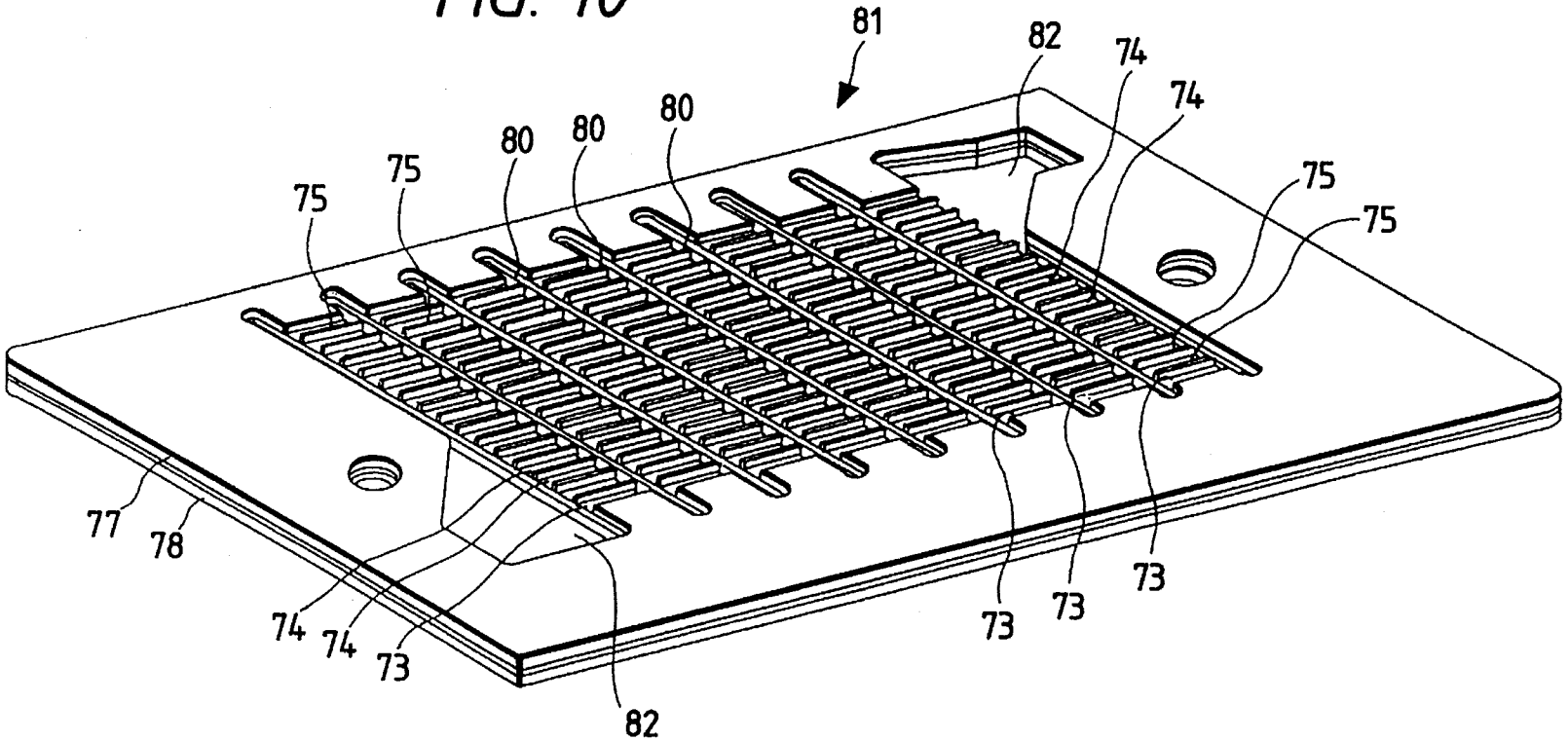
FIG. 10 is a diagram showing a structure of a pressure chamber forming plate in enlarged form.

Reference numeral 81 designates a pressure chamber forming plate, which is arranged as a second layer member for forming pressure chambers with the nozzle plate 70. The pressure chamber forming plate interposes a plurality of vibrating plates 73 between frames 77 and 78, a number of such vibrating plates being equal to a number of nozzle opening arrays. As shown in FIG. 10, each vibrating plate 73 has film-like vibrating portions 74 and horizontally extending walls 75. The vibrating portions 74 are formed by molding a high polymer material having heat resistance and resilience, e.g., polyimide®. Each wall 75 isolates the vertically arrayed nozzle openings 71 from one another and controls the gap between the vibrating portion 74 and the nozzle plate 70 with an end thereof abutting against the back surface of the nozzle plate 70. On both sides of each vibrating plate 73 are gaps provided to allow slits 80 to be formed, the slits being provided to supply ink to the nozzle plate 70. On the frames 77 and 78 are throughholes 82 and 82 provided to supply the ink between the vibrating plates 73 and the nozzle plate 70. These throughholes 82 are designed to widen toward a print region but are disposed outside the print region. In FIG. 10, reference numeral 84 designates positioning holes for assembling.

Figure 11:
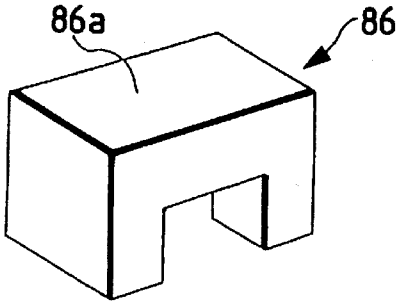
FIG. 11 is a diagram showing an exemplary pressure transmitting member in enlarged form.

Reference numeral 86 designates pressure transmitting members, which are arranged as third layer members to connect vibrating elements 122 (described later) to the vibrating portions 74 of the corresponding vibrating plate 73. In the case of using hot melt ink, a heat-resistant high polymer such as PPS is subjected to injection molding, or a metallic material is etched or pressed so that the pressure transmitting member can be formed into, e.g., a C-shaped member such as shown in FIG. 11 so as to be fitted with a front end of the vibrating element 122. The surface area of the front end 86*a* of the pressure transmitting member is selected so as to be larger than the surface area of the front end of the vibrating element 122 and smaller than the surface area of a single vibrating portion 74 defined by the walls 75. The mass of the pressure transmitting member is set so as to be smaller than the mass of the active region of the vibrating element, i.e., the mass of the vibrating region. More preferably, the mass of the pressure transmitting member is set to about 1/10 the mass of the vibrating region.

Reference numeral 88 designates a pressure transmitting member support plate for positioning the pressure transmitting members 86, which is arranged as a fourth layer member. This pressure transmitting member support plate 88 is formed by providing ladder-like frames 90 so as to be positioned in alignment with the pressure transmitting members 86. The pressure transmitting member support plate 88 is also designed to allow the pressure transmitting members 86 to be held by throughholes 92 provided by the frames 90 in such a manner that the pressure transmitting members 86 can move in the axial direction. Outside the print region are throughholes 94. These throughholes 94 widen toward the print region to supply the ink between the vibrating plates 73 and the back surface of the nozzle plate 70. In FIG. 11, reference numeral 96 designates positioning holes for assembling.

Reference numeral 98 designates a flow path forming plate, which is arranged as a fifth layer member. The flow path forming plate has long holes 100 (described later) that allow the vibrating elements 122 to pass therethrough. Each long hole 100 is disposed at a position confronting an array of nozzle openings, and a moat-like recessed portion that encloses each of these long holes 100 is formed to provide ink supply paths 102. These ink supply paths 102 are formed at such positions as to allow communication with long holes 93 of the pressure transmitting member support plate 88 and the slits 80 of the pressure chamber forming plate 73. These ink supply paths 102 also communicate with throughholes 104 that widen toward the print region but are disposed outside the print region. In FIG. 11, reference numeral 106 designates positioning projections.

Reference numeral 110 designates a vibrating element unit holder, which is arranged as a sixth layer member. This vibrating element unit holder 110 has a window 112 for allowing vibrating element units 120 to pass therethrough and indentations 114 that come in engagement with both ends of the vibrating element units 120. Throughholes 116, 116 for supplying the ink to the first to the fifth layer members are also provided in regions outside the print region. In FIG. 11, reference numeral 118 designates positioning throughholes.

Figure 12:
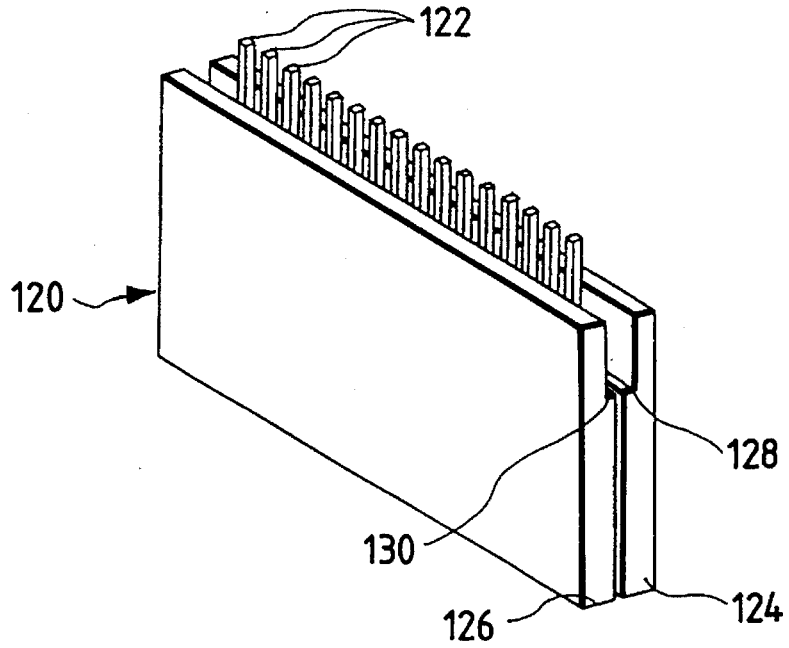
FIG. 12 is a perspective view showing the vibrating element unit in enlarged form.

Reference numeral 120 designates the above-mentioned vibrating element unit, in which a plurality of vibrating elements 122 are arranged so as to be aligned with the nozzle openings 71 as shown in FIG. 12, so that the vibrating element unit 120 is interposed between two substrates 124 and 126. Each of the substrates 124 and 126 is made of a material such as the above-mentioned material whose acoustic impedance is large. Each vibrating element 122 is designed to have the active region and the inactive region as described above. The inactive region is fixed to the substrates 124 and 126 and the length of the active region is selected so that the inactive region extends almost from the fifth-layer flow path forming plate 98 to the pressure transmitting members 86. The substrates 124 and 126 have steps 128 and 130 respectively so that these substrates do not come in contact with the active region of each vibrating element 122.

Reference numeral 134 designates a base having a throughhole 136 and throughholes 138 and 138 outside the throughhole 136. The throughhole 136 can accommodate a necessary number of vibrating element units 120. The throughholes 138 communicate with the openings of the ink flow paths of the base 1 that forms the ink tanks. In FIG. 12, reference numeral 140 designates positioning throughholes.

As a result of the above-mentioned lamination structure, when a plurality of vibrating element units 120 are assembled into the throughhole 136 of the base 134 and then let the window 112 of the vibrating element unit holder 110 allow such assembly to pass therethrough, the substrates 124 and 128 forming each vibrating element unit 120 come in engagement with the indentations 114 of the holder 110, thereby causing each vibrating element unit 120 to be set to a predetermined position. As the projections 106 of the flow path forming plate 98 are inserted into the positioning holes 140 and 118 of the base 134 and the holder 110, respectively, under this condition, the vibrating elements 122 of the respective vibrating element unit 120 project from the long holes 100 of the flow path forming plate 98.

The pressure transmitting member support plate 88 is carried on the thus assembled body so that the front ends of the vibrating elements 122 can pass through the throughholes 92 of the support plate 88. The pressure transmitting members 86 are then inserted into the respective throughholes 92. Accordingly, the pressure transmitting members 86 are set on the front ends of the vibrating elements 122.

Then, when the vibrating plate 73 and the nozzle plate 70 are placed on the thus assembled body while positioned with the projections 106 as a reference, the respective pressure transmitting members 86 abut against the vibrating portions 74 of the vibrating plates 73, so that the pressure chamber 35 (FIG. 4) is formed by a vibrating portion 74 and the walls 75 defining such vibrating portion 74. The thus formed pressure chambers 35 communicate with the nozzle openings 71, respectively.

Upon completion of laminating the respective layer members, these layer members are fixed integrally to complete a head assembly. As this head assembly has been mounted on the base 1 so that the arrays of nozzle openings extend vertically, throughholes 14*c*, 14*d* formed on the cover member 8 of the base 1 are connected to the throughholes 138 of the base 134, thus completing the ink flow paths between the ink tanks 3 and 4 and the head assembly 2.

When pressure is applied to one of the tanks, e.g., the ink tank 3 under this condition as described above, the ink from the ink tank 3 flows the throughholes 138 of the base stand 134 and the throughholes 116 of the holder 110 to reach the throughholes 94 of the flow path forming plate 88. The ink that has reached the flow path forming plate 88 is scattered around while passing through the ink supply paths 102, flowing into the slits 80 of the pressure chamber forming plate 81 from the long holes 93 of the pressure transmitting member support plate 88, then and from the slits 80 to the pressure chambers formed between the vibrating plates 73 and the nozzle plate 70. Since the respective throughholes 92 of the pressure transmitting member support plate 88 are sealed by the vibrating plates 73, the vibrating element units 120 will never be immersed in the ink.

Figure 13:
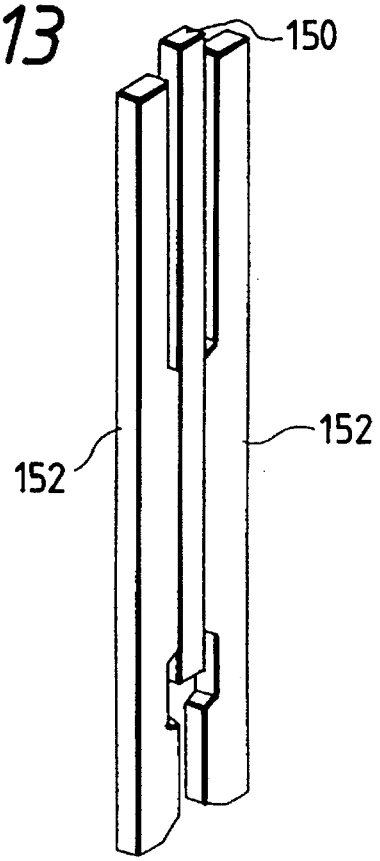
FIG. 13 is a perspective view showing another exemplary vibrating element unit.
Figure 14:
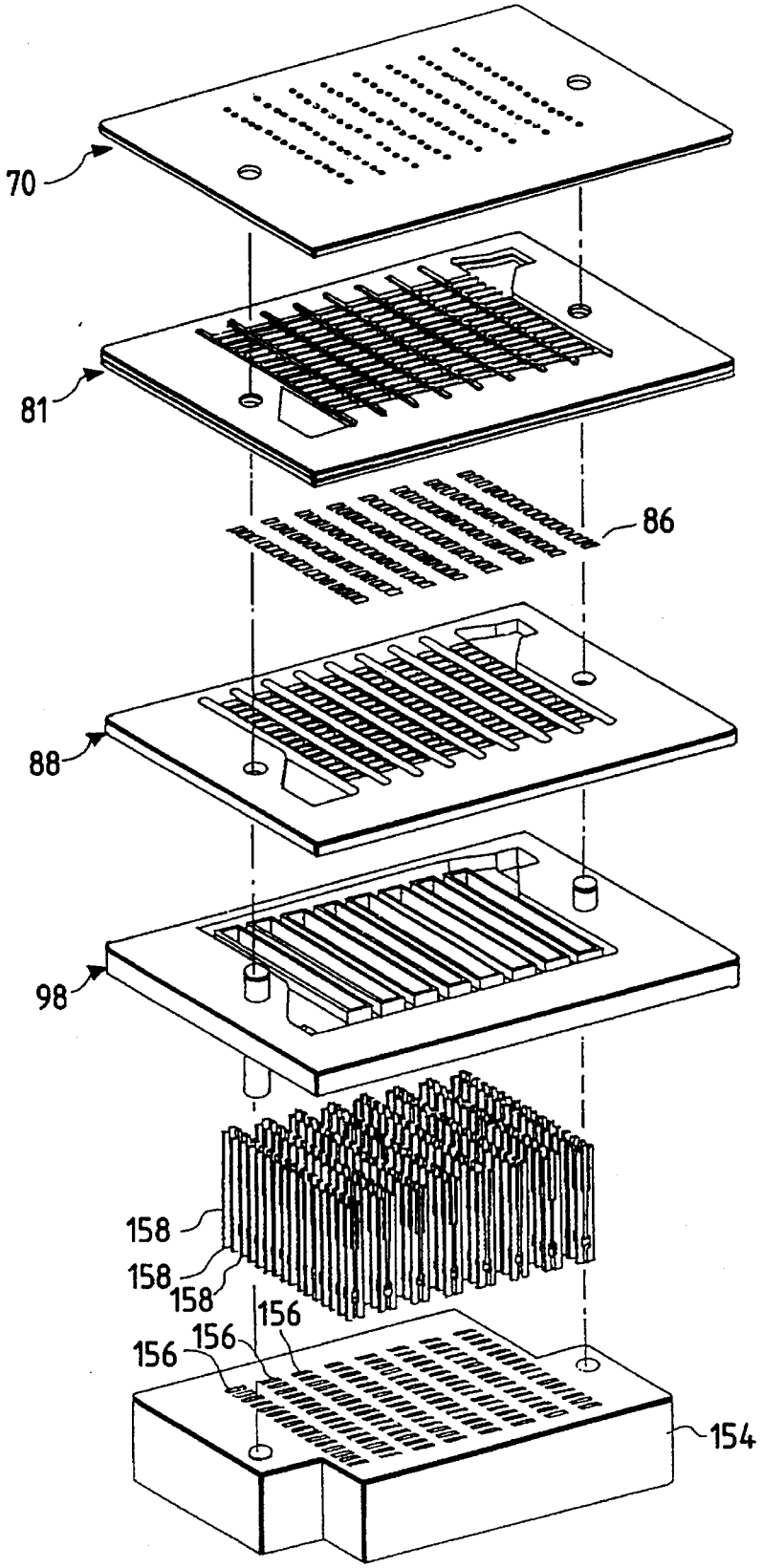
FIG. 14 is an exploded perspective view showing an exemplary head assembly using the vibrating element unit shown in FIG. 13.

While it is designed to fix a plurality of vibrating elements 122 between the long substrates 124 and 126 in this embodiment, as shown in FIG. 13, a single vibrating element 150 may be fixed between substrates 152, each of which substrates has the same width as the vibrating element 150 to achieve a single-vibrating element single-unit construction. In this case, as shown in FIG. 14, throughholes 156 are formed so as to be aligned with vibrating element units 158 and the vibrating element units 158 are set to these throughholes 156 by sliding. By similarly setting the flow path forming plate 98, the pressure transmitting support plate 88, the pressure transmitting members 86, the pressure chamber forming plate 81, and the nozzle plate 70 under this condition, the head assembly can be completed.

This embodiment allows correspondence between a single vibrating element unit and a single nozzle opening. This allows replacement of a defective vibrating element on a single element basis, thereby contributing to reducing maintenance and manufacturing cost.

While pressure is applied to one of the tanks to move the ink to the other tank through the head assembly in the above embodiment, it is apparent that the same effect can be achieved by evacuating one of the tanks.

Figure 15:
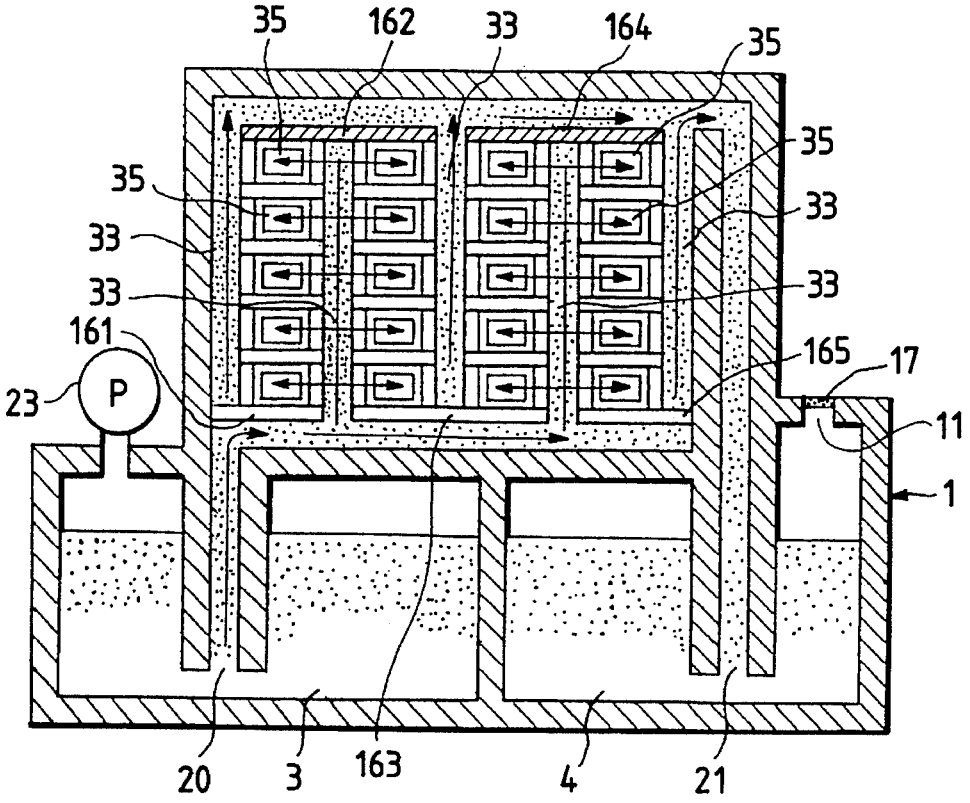
FIG. 15 is a diagrams showing another embodiment of the invention with ink flow paths.

FIG. 15 shows another embodiment of ink supply paths to the respective pressure chambers in the print head of the invention. In this embodiment seal members 161 to 165 are arranged on either an upper or a lower end or ends of the vertically extending arrays of nozzle openings in order to regulate the direction of the ink flowing into the ink supply paths 33. According to this embodiment, the ink flows from a single ink supply path 33 to the other ink supply path 33 via the pressure chambers 35 as shown by arrows in FIG. 15, when the ink passes through the head assembly 2 upon pressuring or evacuating the main tank 3. As a result, the ink can be loaded into the pressure chambers 35 surely by driving out bubbles remaining at the pressure chambers 35 into the supply path 33.

Figure 16:
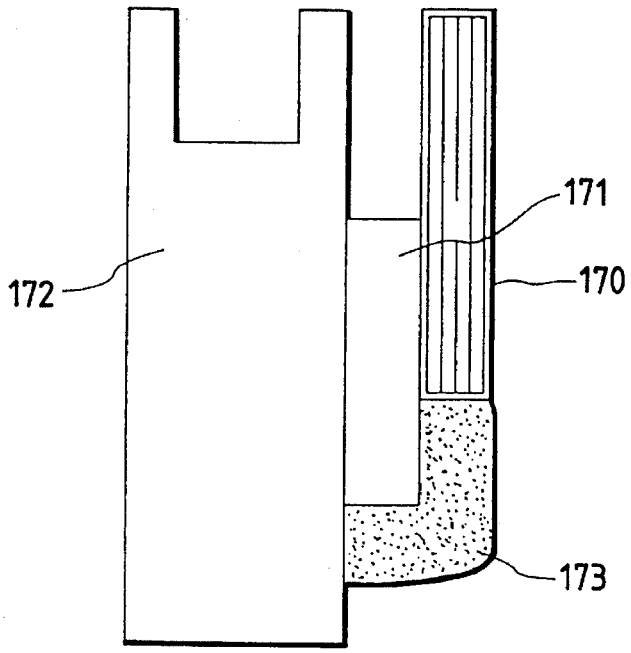
FIG. 16 is a diagram showing still another exemplary vibrating element unit.

While the inactive region of the vibrating element is interposed by the substrates on both sides in the above embodiment, the inactive region may also be fixed only on a single side of the vibrating element as shown in FIG. 16.

That is, the inactive region of a vibrating element 170 is fixed on a substrate 171 on a single side thereof by an adhesive, and then such an adhesive as to become rigid after cured, e.g., an adhesive prepared by mixing ceramic powder with a binder, is applied as far as to a support member 172 in such a manner that the bottom and the exposed other side of the substrate 171 can be covered up.

This technique allows reaction produced at the time of driving the vibrating element to be received by the adhesive layer 173, thus preventing variations in the gap between the nozzle opening and the vibrating element surface accompanied by the deformation of the substrate 171, which further obviates crosstalk.

Figure 17:
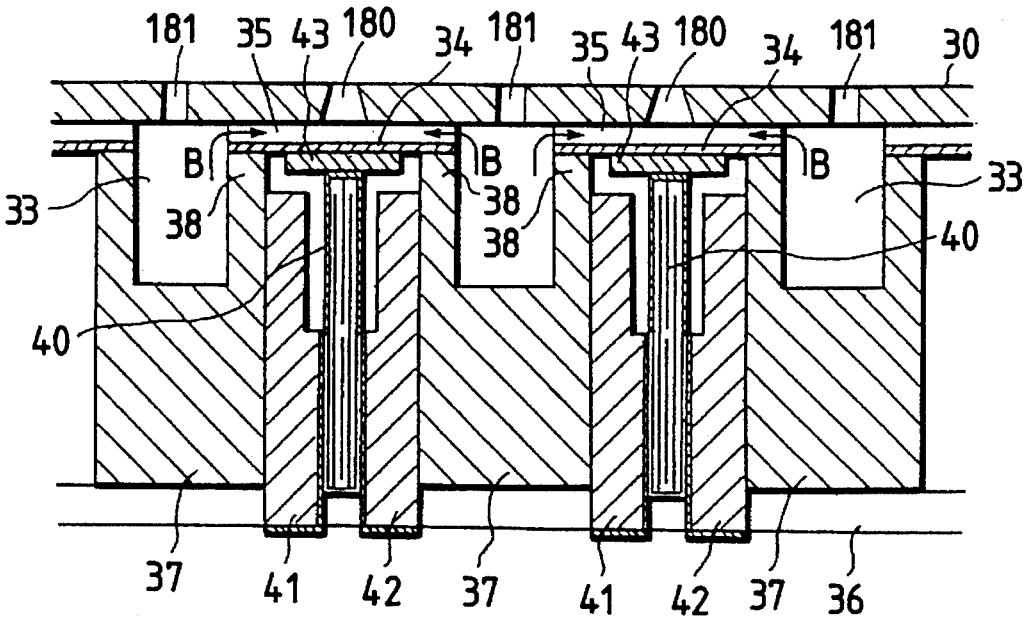
FIG. 17 is a diagram showing another embodiment with a nozzle plate.

FIG. 17 shows another embodiment of the nozzle plate. In FIG. 17, reference numeral 181 designates buffer flow paths arranged at positions as close to nozzle openings 180 as possible and remote from the vibrating plates 34. Each buffer flow path is formed into a throughhole whose diameter is smaller than the nozzle opening 180. The diameter of each buffer flow path 181 is selected to about 45 to 50 μm if the diameter of the nozzle opening is set to 60 μm. It has been verified that-the diameter of the buffer flow path which is 0.6 to 0.95 times that of the nozzle opening can prevent drying of the ink from the buffer flow path as well as crosstalk while maintaining the siphonage.

Figure 18A:
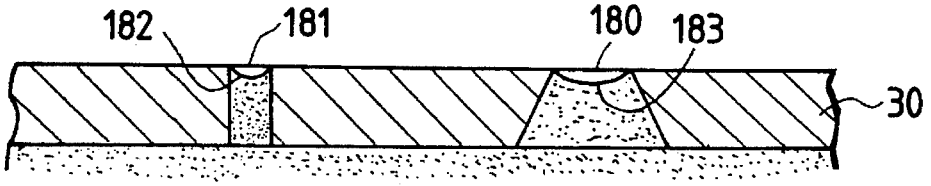
FIGS. 18 (*a*) and 18(*b*) are diagrams illustrative of an operation of the nozzle plate shown in FIG. 17.
Figure 18B:
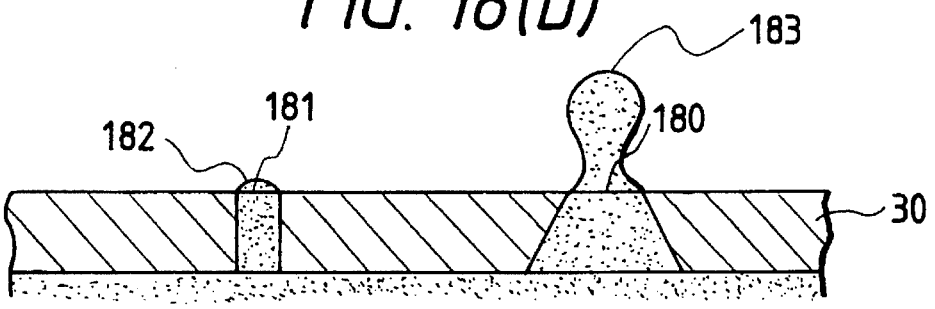

In this embodiment, if no printing is performed, the meniscus 182 of each buffer flow path 181 retreats toward the ink flow path side as shown in FIG. 18(*a*). When a vibrating element 40 is excited to form a dot under this condition, the ink in the pressure chamber 35 is compressed as the vibrating plate 34 confronting the vibrating element 40 projects toward the pressure chamber 35. As a result, an ink droplet jets out from the nozzle opening 180 confronting the vibrating element 40 that has been excited. The change in ink pressure in the pressure chamber 35 is propagated around to apply pressure to the ink in pressure chambers belonging to other nozzle openings that are adjacent to this nozzle opening 180. However, the meniscus 182 of the buffer flow path advances toward the front surface (FIG. 18 (*b*)) by the propagation of pressure undulations, which propagation is absorbed by a change in volume of the meniscus 182, thereby causing the pressure undulations to be damped. As a result, the crosstalk caused by the driving of adjacent vibrating elements can be prevented.

As the pressure undulations are damped in this way, the meniscus of the buffer flow path 181 retreats toward the ink flow path 33 side. Accordingly, dots are sequentially formed by repeating the above-mentioned process while preventing crosstalk to a possible extent.

What is claimed is:

1. An on-demand type ink jet print head, comprising:

a plurality of ink tanks disposed at a lower position of a carriage and being independent of each other;

pressure varying means for varying pressure provided on a first of said tanks;

an air release port communicating with a second of said tanks; and a head assembly provided on top of said tanks communicating with said tanks through first flow paths opposing sides of said head assembly, said head assembly comprising a nozzle array, a pressure chamber corresponding to said nozzle array, and second flow paths being located on opposing sides of said pressure chamber.

2. The on-demand type ink jet print head according to claim 1, wherein each of said tanks comprises a container portion with a front surface thereof being open and a cover plate, said cover plate having said first flow paths on a back surface thereof, said first flow paths extending to said head assembly.

3. The on-demand type ink jet print head according to claim 1, wherein said air release port is air-transmitting and is provided with a filter blocking passage of liquid.

4. An on-demand type ink-jet print head, comprising:

a plurality of ink tanks disposed at a lower position of a carriage and being independent of each other;

pressure varying means for varying pressure provided on a first of said tanks;

an air release port communicating with a second of said tanks; and a head assembly provided on top of said tanks and communicating with said tanks through first flow paths disposed on opposing sides of said head assembly, said head assembly comprising a lamination structure comprising:

a nozzle plate having a plurality of nozzle openings;

pressure chamber forming plate defining pressure chambers in cooperation with said nozzle plate;

a flow path forming plate having second flow paths for supplying ink;

a vibrating element unit having a part of a vibrating element secured to a substrate; and a base for accommodating said vibrating element unit and fixing said nozzle plate, said pressure chamber forming plate, said ink flow forming plate, and said vibrating element unit integrally with one another.

5. The on-demand type ink jet print head according to claim 4, wherein said pressure chamber forming plate has a vibrating portion at a position confronting said nozzle openings and walls defining a single direction between said nozzle openings.

6. The on-demand type ink jet print head according to claim 4, wherein said flow path forming plate comprises a throughhole for allowing passage of said vibrating element and a recessed portion formed so as to enclose said throughhole.

7. The on-demand type ink jet print head according to claim 4, wherein said pressure chamber forming plate, said flow path forming plate, and said base have throughholes for forming ink supply paths communicating with said ink tanks at portions outside a print region.

8. The on-demand type ink jet print head according to claim 4, wherein a throughhole whose diameter is smaller than said nozzle openings is arranged at a region confronting said ink flow path of said nozzle plate to allow a buffer flow path for preventing crosstalk to be formed.

9. The on-demand type ink jet print head according to claim 8, wherein a diameter of said buffer flow path is 0.6 to 0.95 times said diameter of said nozzle openings.

10. An on-demand type ink jet print head, comprising:

a pressure chamber having a corresponding nozzle opening;

a vibrating plate constituting one wall of said pressure chamber;

vibrating element means for vibrating said vibrating plate, wherein said vibrating element means comprises:

a first portion defining an inactive region secured, with respect to a fixed end of said vibrating element means, to a substrate;

a second portion defining an active region operatively coupled, with respect to a free end of said vibrating element means, to said vibrating plate; and a third portion separating said first and said second portions;

wherein said inactive region comprises a first lamination structure having a first electrode layer, a piezoelectric material, and a second electrode laminated to one another, wherein said active region comprises a second lamination structure including a first electrode, said piezoelectric material, and said second electrode, wherein said first and said second electrodes are not conductive with one another, and wherein said first electrode is separated from said first electrode layer by additional piezoelectric material disposed in said third portion to thereby electrically disconnect said first electrode from said first electrode layer.

11. The on-demand type ink jet print head according to claim 10, wherein said substrate has an acoustic impedance higher than an acoustic impedance of said vibrating element means.

12. The on-demand type ink jet print head according to claim 10, further comprising a pressure transmitting member operatively coupled to said vibrating element means.

13. The on-demand type ink jet print head according to claim 10, wherein said vibrating element means is interposed between two substrates.

14. The on-demand type ink jet print head according to claim 13, wherein a mass of said pressure transmitting member is 1/10 times a mass of said active region.

15. The on-demand type ink jet print head according to claim 13, wherein said pressure transmitting member is of C-shape.

16. The on-demand type ink jet print head according to claim 10, further comprising a support member for fixing said substrate and said pressure chamber.

17. The on-demand type ink jet print head according to claim 10, wherein said first electrode layer and said second electrode are not conductive with one another.

* * * * *